United States Patent [19]

Balogh

[11] Patent Number: 4,973,087

[45] Date of Patent: Nov. 27, 1990

[54] SPECIAL EFFECT POSTCARD WITH INTEGRAL VIEWER

[76] Inventor: John Balogh, 852½ S. Hobart, Los Angeles, Calif. 90005

[21] Appl. No.: 528,534

[22] Filed: May 25, 1990

[51] Int. Cl.[5] ..... B42D 15/00

[52] U.S. Cl. ..... 283/62; 283/117; 40/365; 40/427; 350/140

[58] Field of Search ..... 283/87, 117, 62; 40/124.1, 365, 427; 350/140, 143, 130, 317

[56] References Cited

U.S. PATENT DOCUMENTS

| | | | |
|---|---|---|---|
| 3,291 | 2/1869 | Mascher | 350/140 |
| 40,654 | 11/1863 | Tresize | 350/140 |
| 906,774 | 12/1908 | Colwell | 350/140 |
| 991,948 | 5/1911 | Carley | 350/140 |
| 1,989,454 | 1/1935 | Köster | 40/365 |
| 2,190,646 | 2/1940 | Branson | 350/140 |
| 2,616,333 | 11/1952 | Tinker | 350/140 |

*Primary Examiner*—Paul A. Bell
*Assistant Examiner*—Hwei-Siu Payer
*Attorney, Agent, or Firm*—Charles H. Thomas

[57] ABSTRACT

A mailing card is formed of a single sheet of card stock in which a perforated delineation extends entirely across the sheet of card stock to define first and second portions thereof and to facilitate complete separation of those portions from each other. An opening with at least one transparent window tinted in a first color is defined in the first portion of the card stock. Matter is printed on the second portion of the card stock in both the color of the window and in at least one other contrasting color. The first and second portions of the card stock are separated from each other. The printed matter on the second portion is then viewed through the window in the first portion which masks the matter printed in the same color as the window. Hidden messages can thereby be decoded in this manner. Also, a pair of transparent anaglyphic windows can be provided on the first portion of the card stock to view a picture printed anaglyphically on the second portion of the card stock when the first and second portions are completely separated from each other.

15 Claims, 5 Drawing Sheets

SPECIAL EFFECT POSTCARD WITH INTEGRAL VIEWER

BACKGROUND OF THE INVENTION

1. Field of the Invention

The present invention relates to a mailing card formed as a single sheet of card stock and having a viewer formed with a transparent window in one detachable portion of the card stock and matter printed on the other portion of the card stock. Observation of the printed matter through the viewer creates special visual effects for the observer.

2. Description of the Prior Art

In the past, various devices designed to create three dimensional effects when viewed have been constructed so as to be capable of transmission through the mails. However, all such prior devices have been unnecessarily complex and have entailed significant limitations that detract from their usefulness.

U.S. Pat. No. 2,283,777 discloses a greeting card which includes various sections that are disposed in a stacked arrangement for mailing and which, when unfolded, form a type of box viewer. The box viewer employs a pair of stereoscopic windows, one of which is blue and the other of which is red. However, this device involves a multiplicity of thicknesses of card stock when folded for mailing. Furthermore, the device involves a complex system of folds for deployment following receipt. Furthermore, even when all of the sheets are unfolded, the viewing windows are necessarily held at a single fixed distance from a scene to be viewed. Different viewing sheets must be stitched, stapled or otherwise secured together in order for the device to function. The several thicknesses of card stock of the folded device prevent the structure from being transmitted through the mails at the postcard rate.

U.S. Pat. No. 4,846,553 discloses a foldable viewer for producing a stereoscopic image and which is comprised of a folding, multi-thickness device that requires a pair of relatively thick, focusing lenses and a pair of pictures of the same subject viewed from slightly different vantage points. Each lens is disposed in front of a separate one of the images, which are located side by side. The several plies of the device are all locked together. The device is unfolded for use to a condition in which each of the lenses is located at a prescribed distance from a specific one of the images. The device is a box viewer which can be collapsed into several thicknesses and sent through the mails. However, due to the several thicknesses of folded paper of card stock of which it is constructed, the device cannot pass through the mails at the postcard postal rate. Furthermore, since the device requires two complete non-overlapping pictures of the same subject to be located side by side, each picture must be quite small. The lenses, therefore, must be thick so as to achieve magnification.

Other prior art devices have provided a combination of a viewer formed of a pair of anaglyphic windows attached to a postcard and secured by an attachment flap in the binding of a magazine. The user, upon reading the magazine, is invited to detach the viewer with the anaglyphic windows from the postcard and from the attachment flap in the magazine by means of lines of perforations. The anaglyphic viewer can then be used to view pictures in the magazine. The postcard could likewise be detached from the magazine attachment flap and sent through the mails to obtain video information.

Thus, the anaglyphic viewer, though initially connected to the postcard, had no relationship therewith once removed from the postcard, and the postcard does not contain any printed matter that will produce special visual effects.

Postcards have previously been constructed as devices with anaglyphic images imprinted thereon. However, such postcards have relied upon the recipient to independently procure an anaglyphic viewer having different colored lenses corresponding to the different colors printed on the postcard. If the recipient of the postcard does not have an anaglyphic viewer readily at hand, the postcard is essentially useless.

SUMMARY OF THE INVENTION

In one broad aspect the present invention may be considered to be a mailing card formed of a single sheet of card stock, a perforated delineation extending entirely across the sheet of card stock to define first and second portions thereof and to facilitate complete separation of the first and second portions from each other, and at least one opening defined in the first portion of the card stock. At least one transparent window tinted in a first color is provided and is disposed in the opening. Matter is printed on the second portion of the card stock in both the first color which is the same as that of the window and in at least one other contrasting color. As a result, separation of the first and second portions of the card stock and viewing of the printed matter on the second portion of the card stock through the window in the first portion of the card stock masks the matter printed in the first color on the second portion from observation through the window.

As an example, a mailing card is provided having a single red tinted window in the first portion of the card stock. This fist portion serves as a viewer when separated from the remaining second portion of the card stock. A puzzle or problem is posed by means of printing on the second portion of the card stock. The printed matter includes at least some matter printed in the same shade of red corresponding to the red tint of the viewing window. In addition, the printing on the second portion of the card stock includes the solution to the problem or puzzle. This solution is printed in a contrasting color, such as blue, superimposed with the red printing.

The solution to the puzzle or problem presented in blue colored printing is hopelessly obscured by the superimposed printing in red when the printed matter on the second portion of the card stock is viewed in ambient light with the unaided eye. When that same printed matter is viewed through the red tinted transparent window of the viewer, however, the red tint of the viewer masks the red printing on the second portion of the card stock, thereby allowing the solution to the problem or puzzle that is printed in the contrasting blue color to be viewed through the viewer.

In another variation of the invention the viewer is an anaglyphic viewer having a pair of windows tinted in contrasting colors, for example red and blue. The printed matter may contain a picture printed anaglyphically. That is, a picture of the same subject matter viewed from slightly different vantage points, is printed in a superimposed manner on the second portion of the card stock. The printed matter includes printing in both red and blue, wherein all of the red printing appears in the picture as viewed from one vantage point, and all of the blue printing appears in the image of the same subject as viewed from a vantage point slightly to the side of the first vantage point. By viewing the superimposed images while looking through the red window with the left eye and through the blue window with the right eye, the images conveyed to the observer are processed by the brain to produce a single composite three dimensional image.

The mailing card of the present invention has the distinct advantage over prior three dimensional image mailing card systems of providing an article which can be mailed flat and at the post card rate, yet which contains both a picture to be viewed and a viewing device in a single sheet of card stock. Thus, the recipient need not be relied upon to have at hand a suitable viewer. To the contrary, the viewer is provided by means of a detachable, marginal portion of the postcard. Furthermore, the other remaining portion of the postcard from which the viewer is detached contains a picture which may be viewed using the viewer to achieve a special visual effect.

Unlike prior systems, the viewer and the printed matter to be viewed are provided in a single sheet of card stock. The viewer and the printed matter remain coupled together until actual use by the recipient, at which time they are totally and completely separated from each other. The system thus avoids the complexity of folding and assembly by the recipient and the increased postage which is required in conventional three dimensional imaging systems designed for transmission through the postal system.

Because the mailing card of the invention can be transmitted through the mails in a flat condition within the specifications necessary to receive the reduced postal rate of a postcard, the device can be utilized as an economical promotional device. Heretofore, the multilayered box-type stereoscopic viewers which have been transmitted through the mails have had dimensions of thickness and weight such that they were not entitled to the reduced postage rates applicable to postcards. As a consequence, the large postage required for each such prior art devices rendered them impractical for use as mass promotional mailers.

Furthermore, the mailing card of the invention is not only simpler in construction, but far simpler in utilization than prior stereoscopic mailers. Most prior art self-contained stereoscopic viewing devices adapted for transmission through the mails have been box viewers of the type which require a pair of separate, side by side, nonsuperimposed images designed to be viewed separately through a pair of side by side lenses. However, a three dimensional effect can only be achieved in such a system when the lenses are located a prescribed and precise distance from an associated image, and focused upon that image. As a consequence, each of the prior art stereoscopic units had to be erected from a collapsed condition through a complicated series of steps of unfolding panels and interlocking of tabs on panels in order to assemble the box viewer.

In contrast, applicant's invention is far simpler in operation. To utilize applicant's device, the user is not required to unfold any sheets or interlock any tabs to erect any type of device, such as a box viewer. Quite to the contrary, the original portion of the mailing card containing the viewing window or windows is merely separated from the remainder of the mailing card by a force exerted along a perforated demarcation. The viewer is then positioned in front of the eyes of the user and the printed subject matter o the remainder of the flat sheet of card stock can be viewed from any distance. Thus, the mailing card of the invention is far simpler both in construction and operation as contrasted with prior art devices.

The invention may be described with greater clarity and particularity with reference to the accompanying drawings.

DESCRIPTION OF THE EMBODIMENTS

Figure 1:
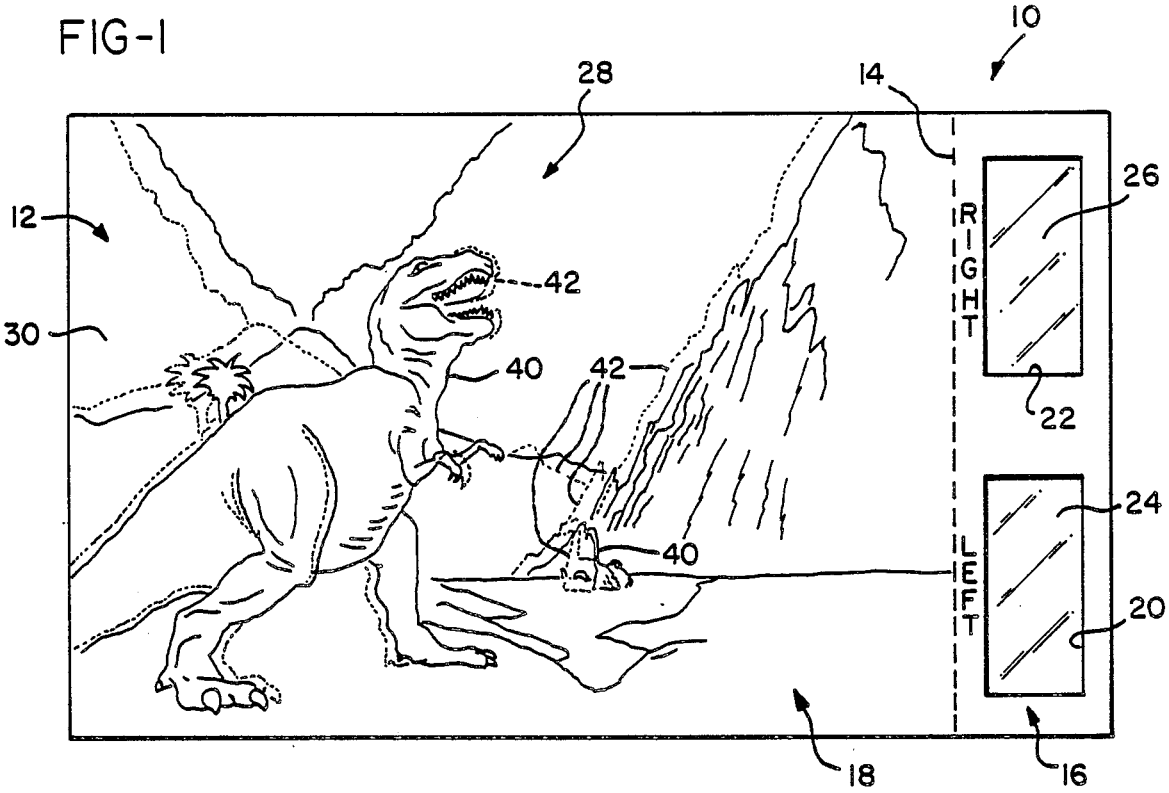
FIG. 1 is a plan view of the face of one embodiment of a mailing card according to the invention.
Figure 2:
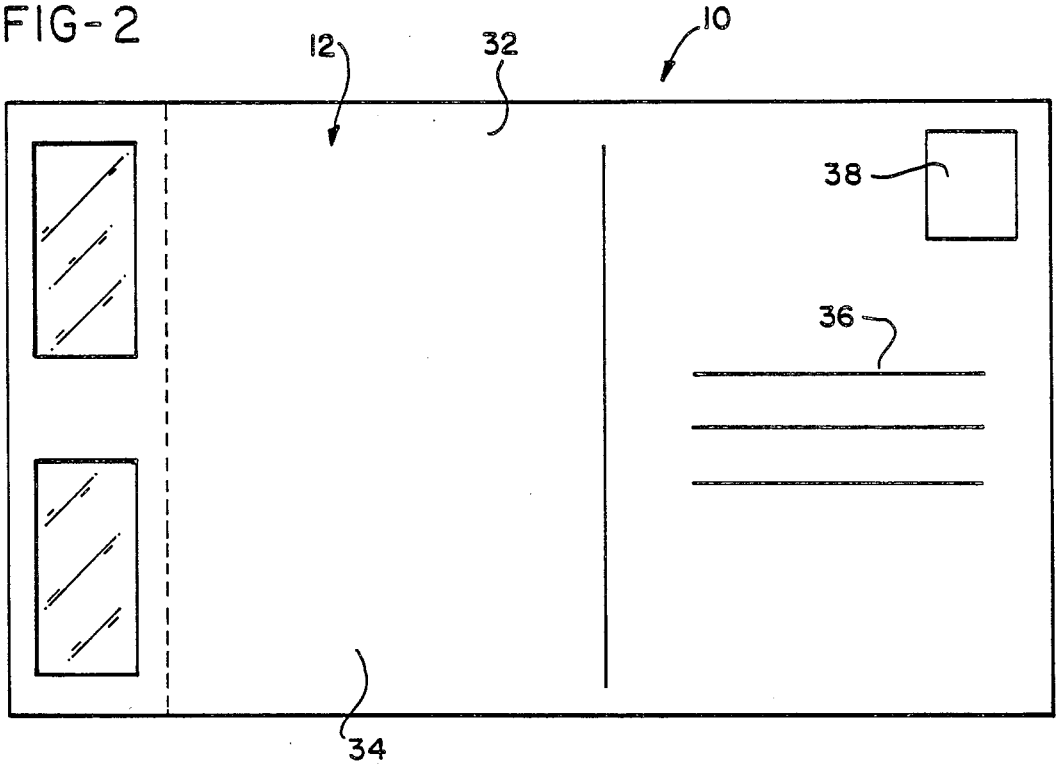
FIG. 2 is a plan view of the obverse surface of the mailing card of FIG. 1.

FIG. 1 illustrates a mailing card 10 formed of a single sheet of card stock 12. A perforated demarcation 14 extends entirely across the sheet of card stock 12 to define a first marginal portion 16 and a second remaining portion 18 thereof. The perforated delineation 14 facilitates complete separation of the first and second portions 16 and 18 from each other when the mailing card 10 is utilized following receipt. A pair of openings 20 and 22 are defined in the marginal portion 16 of the card stock 12 and are spaced from each other a distance corresponding to the distance between the eyes of a human being. A set of transparent anaglyphic windows 24 and 26 are secured across the openings 20 and 22, respectively, in the marginal portion 16. An anaglyphic picture 28 is printed on the flat top face 30 of the remaining portion of the card stock 12 which is visible in FIG. 1. The opposite obverse surface 32 of the card stock 12 is provided with a region 34 for writing a personalized message, a region 36 for writing an address, and an indicia 38 indicative of the proper placement of a postage stamp in the upper right hand corner.

The windows 24 and 26 are anaglyphic windows and the picture 28 is printed anaglyphically in colors corresponding to the tint of the windows 24 and 26. According to prevailing convention, the window 24 designed to be positioned in front of the left eye is labeled accordingly and is tinted red. The window 26 intended for use in front of the right eye of the user is likewise labeled accordingly and is tinted blue.

The anaglyphic picture 28 is made up of two slightly different views of the same subject matter printed at least partially in contrasting red and blue colors. The printing in red ink is indicated by the solid lines, such as at 40, for example, while the printing in blue ink is indicated in dotted lines, as indicated at 42, for example. It is to be understood that the printing in blue ink is not discontinuous as it appears in the dotted line convention adopted to distinguish it herein from the red printing 40. To the contrary, the blue ink printing is printed in solid lines, but is laterally offset from the red printed lines 40

The degree and direction of offset of the blue printing 42 from the red printing 40 produces a three dimensional image to an observer viewing the anaglyphic picture 28 through the windows 24 and 26 of the marginal portion 16 of the card stock 12, once that marginal portion 16 has been separated from the remaining portion 18.

The spacing between the openings 20 and 22 in the marginal portion 16 of the card stock 12 is such as to allow most human beings to be able to position the marginal portion 16 in front of their eyes so that the window 24 is located directly in front of the left eye, and the window 26 is located directly in front of the right eye. Preferably, the facing edges of the windows 24 and 26 are separated from each other by a thickness of opaque card stock of between about one half and one and one half inches in thickness. Each of the windows 24 and 26 may be between about one inch and two inches in width. These dimensions allow the marginal portion 16 to be positioned in front of the eyes of a user and for the picture 28 to be observed without difficulty while the user looks through the window 24 with the left eye and through the window 26 with the right eye. The marginal portion 16 is preferably labeled with the word "LEFT" adjacent to the window 24 and with the word "RIGHT" adjacent to the window 26, as illustrated in FIG. 1.

It is extremely important for the mailing card of the invention to be acceptable for transmission by governmental postal services, preferably at the postcard rate. To be acceptable for transmission as a postcard by the governmental postal service, the mailing card 10 of the invention must be rectangular in shape and may not be smaller than three and one half inches by five inches nor larger than four and one quarter inches by six inches. Also, to be mailed as a postcard the mailing card 10 must have a thickness not less than 0.007 inches and not greater than 0.0095 inches.

Some mailing cards of the invention may not meet the standards for mailing as a postcard. Nevertheless, they can still be mailed as standard pieces of first class mail if the width of the mailing card is no greater than six and one eighth inches, the length of the mailing card is not greater than eleven and one half inches and the ratio of length to width is such that the mailing piece fits within a template provided by the United States Postal Service as Notice 3A, dated May, 1981. Also, to qualify for standard first class mail the piece must be one ounce or less, must be at least 0.007 inches thick and no more than 0.25 inches thick. Mailing cards which do not meet these requirements may still be mailed through the postal system, but are subject to a surcharge that is added to non standard mail.

Upon receipt of the mailing card 10 the recipient will normally be able to tell from the overlapping lines 40 and 42 printed in different colors, and from the different colored windows 24 and 26 that the picture 28 is an anaglyphic picture and will exhibit a three dimensional image when viewed through the windows 24 and 26. It then becomes apparent that the recipient need merely detach the marginal portion 16 from the remaining portion 18 along the perforate demarcation 14 by pulling the two portions 16 and 18 apart. The recipient then merely positions the marginal portion 16 in front of his or her face and views the picture 28 with both eyes open, looking through the red tinted window 14 with the left eye and through the blue tinted window 26 with the right eye.

The red tinted window 24 will thereupon mask the lines 40 printed in red, while the blue tinted window 26 will thereupon mask the lines 42 printed in blue. Thus, the recipient's right eye will view the objects depicted in the picture 28 from a slightly different standpoint than the left eye. The composite image produced will cause the objects illustrated in the picture 28 to appear to be located at different distances from the viewer and to stand out from or be recessed into the plane of the card stock 12.

Most adult recipients will require no instruction concerning the intended us of the mailing card 10 beyond that illustrated in FIG. 1. The manner of detachment of the marginal portion 16 from the remaining portion 18 and the placement of the lenses 24 and 26 are apparent. If desired, however, more detailed instructions can be placed on the mailing card 10 on either the face 30 or the obverse surface 32.

The mailing card 10 can be utilized by the sender with no preparation other than affixation of a postage stamp of appropriate denomination on the indicia 38 and writing the address of the recipient in the lined area 36 on the obverse side 32 of the mailing card 10. However, the sender will often prefer to additionally write a brief message to the recipient in the area 34 on the obverse surface 32, although this is solely a matter of elective choice on the part of the sender.

If desired, the mailing card 10 can be manufactured with pictures 28 printed on both the front face 30 and the obverse surface 34 of the card stock 12. Unlike prior mailing cards containing systems for viewing images in three dimensions, the mailing card 10 requires no moving parts, no interlocking tabs, and there is no requirement for assembly into a box-type structure. The windows 24 and 26 are merely sections of colored celluloid or other plastic, and need not and do not provide any focusing effect whatsoever. The image 28 can thereby be viewed by the user from any distance, unlike conventional stereoscopic box-type, multi-thickness viewing cards. The lenses 24 and 26 may be affixed to either the face 30 or the obverse surface 32 of the card stock 12, but preferably are permanently entrapped between the plies of paper forming the card stock 12 so that they are permanently held in position without the necessity for separate adhesive or staples.

The anaglyphic picture 28 illustrated in FIG. 1 represents only one form which the printed matter on the card stock may take. Mailing cards according to the invention may be used in numerous different types of amusement devices, or as retail, advertising, promotional and premium vehicles.

Figure 3:
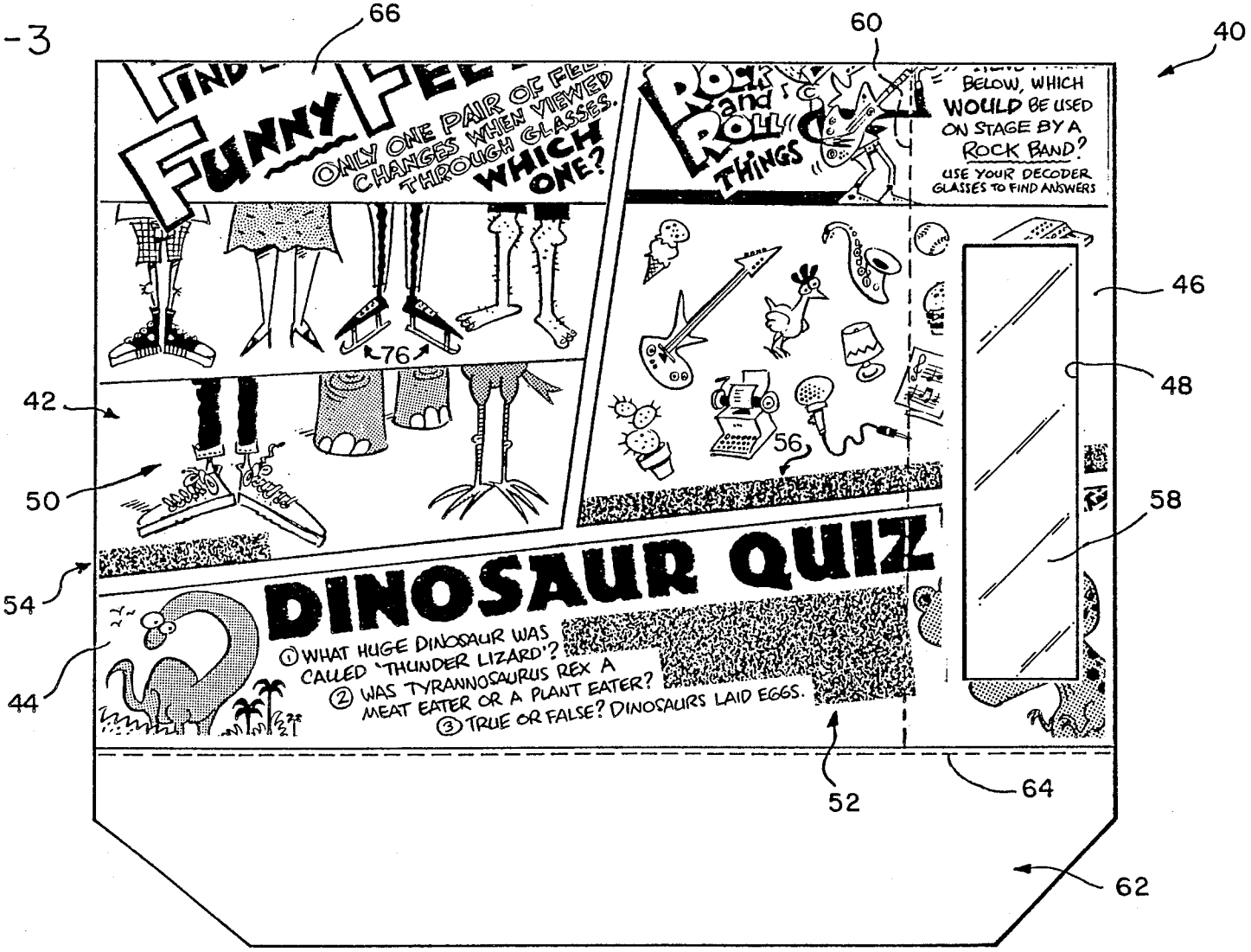
FIG. 3 is a plan view of the face of an alternative embodiment comprising a mailing card according to the invention.
Figure 4:
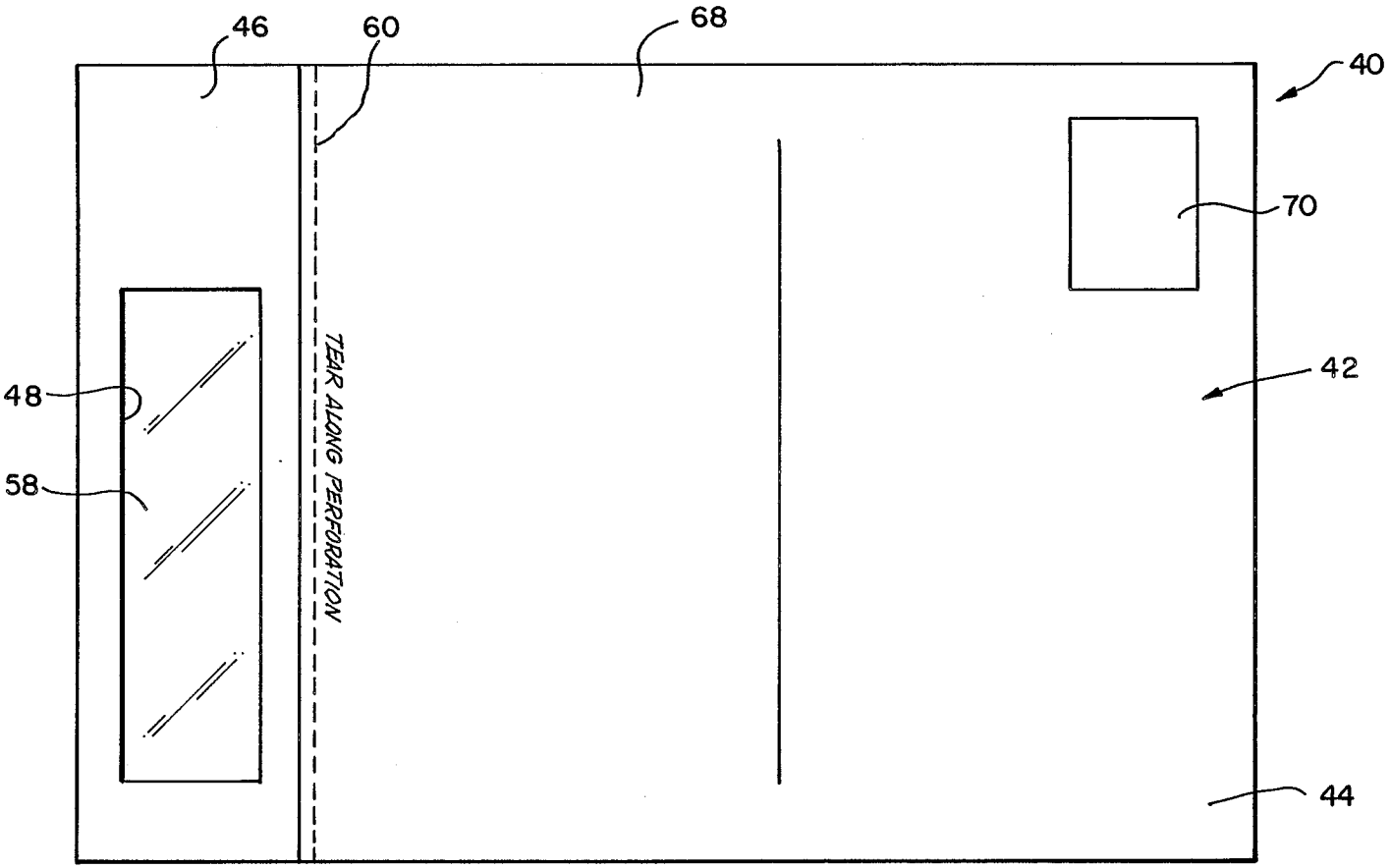
FIG. 4 is a plan view of the obverse surface of the mailing card of FIG. 3 after separation thereof from its attachment flap.
Figure 5:
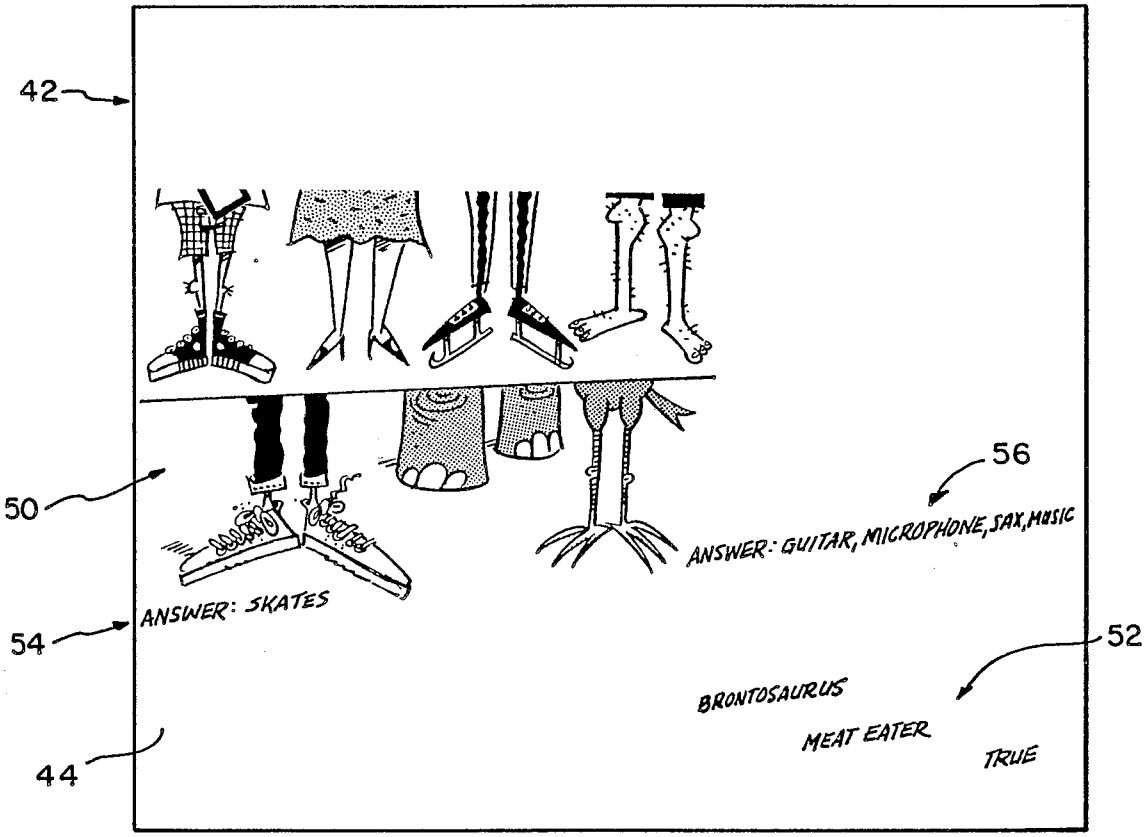
FIG. 5 illustrates the printed subject matter on the mailing card of FIG. 3 as viewed through the viewer thereof after complete detachment of the viewer from the mailing card of FIG. 3.

FIGS. 3, 4 and 5 illustrate another embodiment of the invention. FIGS. 3 and 4 illustrate a mailing card 40 comprising a flat sheet of card stock 42. The card stock 42 includes a rectangular portion 44 and a marginal portion 46 with an opening 48 defined therein. Matter 50, such as the fanciful drawings and text illustrated in FIG. 3 is printed on at least the rectangular portion 44. The matter 50 is printed in a plurality of colors, such as red and blue on the rectangular portion 44 of the card stock 42 which is separable from the marginal portion 46.

The printing in at least one of the colors in the printed matter 50 represents a solution to a problem posed in the printed matter 50. However, this solution is obscured by the rest of the printed matter 50 on the portion 44 of the card stock 42 when viewed in ambient light, as illustrated in FIG. 3. For example, the area 52 of the printed matter 50 may be an area printed with a mottled pattern of red ink, certain portions of which are superimposed over, or printed beneath printing in blue ink. The same is true of the areas 54 and 56. When the areas 52, 54 and 56 are viewed in ambient light, the blue printing therein is only vaguely discernable, and forms no intelligible message, but rather appears as an indecipherable blur in those areas.

The marginal portion 46 of the card stock 42 contains a single transparent window 58 tinted in one of the colors of the printed matter 50. Specifically, in the embodiment described the window 58 is tinted red in color and is set in the opening 48, preferably by securement between the plies of paper forming the card stock 42.

In the embodiment of FIGS. 3–5, the printed matter 50 is printed in red and some color other than red, such as blue, in overlapping fashion whereby matter printed in blue on the portion 44 of the card stock 42 represents a solution to a problem posed in the printed matter 50. The solution printed in blue is obscured by the rest of the printed matter, which includes printing in red ink on the portion 44 of the card stock 42 when viewed in ambient light, as depicted in FIG. 3. However, following complete separation of the marginal portion 46 from the remaining portion 44, the printed matter 50, when viewed through the red tinted window 58 of the marginal portion 46, renders visible the solutions printed in blue ink by masking the portions of the printed matter 50 which are printed in red ink. The window 58 thereby masks observation of the portions of the matter printed in red ink to thereby reveal the solutions to the problems which are printed in blue ink.

A linear perforation 60 delineates a boundary between the marginal portion 46 and the remaining portion 44 of the card stock 42 for facilitating complete separation of these two portions from each other. In addition to the portions 44 and 46, the embodiment of the invention depicted in FIGS. 3–5 is also initially provided with a detachable attachment flap 62. The attachment flap 62 is a trapezoidal region of the card stock 42 and is defined by a separable delineation in the form of another linear perforation 64. The attachment flap 62 is thereby adapted for securement within a publication. For example, the attachment flap 62 may be positioned within a magazine and held such that the line of perforation 64 runs along the spine of the magazine. The attachment flap 62 thereby may be secured by a staple or otherwise in the binding of the magazine, or merely held by entrapment between the magazine pages such that the attachment flap 62 folds along the perforated line 64 to form a dihedral with the portions 44 and 46.

The mailing card 40 may thus be circulated with a magazine to serve as a detachable mailer. In this embodiment the portions 44 and 46 of the mailing card 40 are separated from the attachment flap 62 together as a unit by pulling them together away from the attachment flap 62 so that they separate therefrom together along the perforated line 64. The portions 44 and 46 can thereupon be mailed as a unit. FIG. 4 illustrates the obverse side of the portions 44 and 46 of the mailing card 40 after separation from the attachment flap 62 and prior to use by the recipient.

FIG. 3 illustrates the face surface 66 of the card stock 42, while FIG. 4 illustrates the opposite obverse surface 68 thereof following separation of the card stock portions 44 and 46 from the attachment flap 62. The combined shape of the portions 44 and 46, when separated as a unit from the attachment flap 62, is rectangular. At least some of the printed matter 50 appears on the face 66 of the card stock 42, while an indicia 70 of placement of a postage stamp is printed on the opposite obverse surface 68.

The linear perforation 60 that delineates the boundary between the first marginal portion 46 and the second remaining portion 44 of the card stock 42 facilitates complete separation of those portions 46 from each other. The recipient of the mailing card 40 merely pulls the marginal portion 46 laterally apart from the remaining portion 44 such that the two portions separate along the perforated line 60. Once the marginal portion 46 has been separated from the remaining portion 44, the recipient of the mailing card 40 can look at the printed matter 50 on the face 66 of the remaining portion 44 through the single red tinted window 58.

The user can view the printed matter 50 through one or both eyes, looking through the red tinted window 58. When the printed matter 50 is viewed in this fashion, all of the matter which is printed in ink having the same color as the window 58 is obscured from view. More specifically, when the printed matter 50, depicted in FIG. 3, is viewed through the red tinted window 58 in the detached portion 46 of the card stock 42, the user will see only the printed matter depicted in FIG. 5. The window 58 thereby masks observation of portions of the matter printed in the same color as the window 58, namely the color red, to thereby reveal the solutions printed in blue to the problems posed in the printed matter 50.

To illustrate, the printed matter 50 of FIG. 3 contains the following printing in red ink adjacent to the section 52: (1) WHAT HUGE DINOSAUR WAS CALLED 'THUNDER LIZARD'? (2) WAS TYRANNOSAURS REX A MEAT EATER OR A PLANT EATER? (3) TRUE OR FALSE? DINOSAURS LAID EGGS." While the solutions to these problems or questions are not apparent in the area 52 when that area is viewed in ambient light as illustrated in FIG. 3, when the same area 52 is viewed through the red tinted window 58 in the detached marginal card stock portion 46, all of the red printing is obscured Therefore, only the blue printing in that area, indicated at 52 in FIG. 5, is visible Thus, the answers are revealed to an observer who uses the viewing portion 46, as illustrated in FIG. 5.

The same is true of the printed area 54 which includes a rectangular block of red printing that obscures the underlying answers printed in blue ink When viewed in ambient light the blue printing in area 54 is indecipherable from the red printing, as illustrated in FIG. 3. However, when viewed through the red tinted window 58, as illustrated in FIG. 5, the answer to the problem posed becomes apparent That is, the words "ANSWER: SKATES" appear as the solution to the problem presented in the printed matter 50: "ONLY ONE PAIR OF FEET CHANGES WHEN VIEWED THROUGH GLASSES. WHICH ONE?" Moreover, when the printing matter 50 is viewed through the tinted window 58, the skates 76, which are printed in red ink, are not visible, as illustrated in FIG. 5, as they were when viewed in ambient light, as illustrated in FIG. 3.

Likewise, the solution printed in blue ink in the area 56, namely, "ANSWER: GUITAR, MICROPHONE, SAX, MUSIC" becomes apparent, as illustrated in FIG. 5 when viewed through the red tinted window 58.

These words represent a solution to the problem "ITEMS PICTURED BELOW, WHICH WOULD BE USED ON STAGE BY A ROCK BAND?" that is presented by the printed matter 50 as illustrated in FIG. 3.

Figure 6:
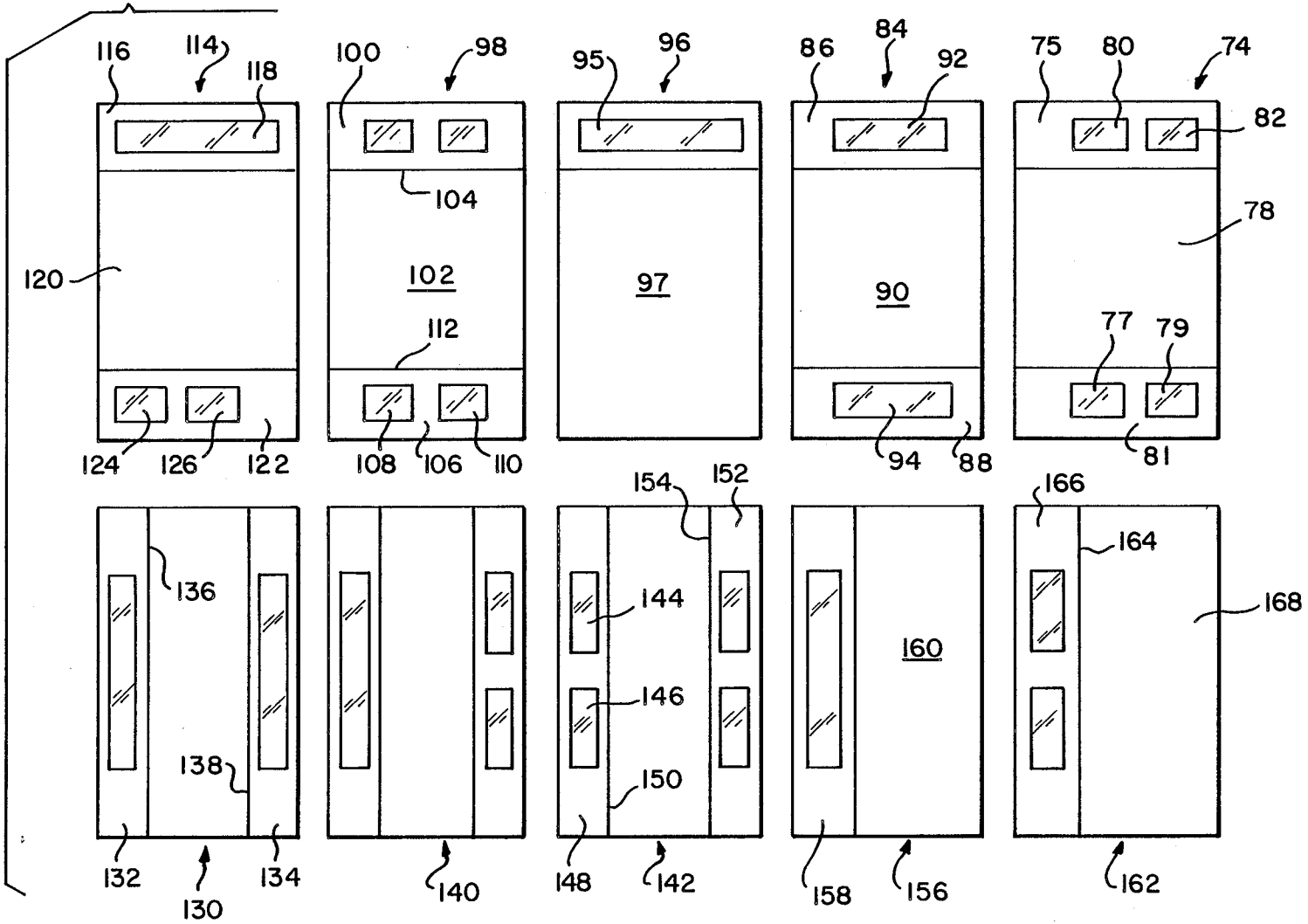
FIG. 6 illustrates other alternative embodiments of mailing cards according to the invention.

Other embodiments of the invention are also possible, as illustrated in FIG. 6. A mailing card 74 is formed of a single thickness of card stock has a configuration similar to that of the mailing card 10 insofar as the anaglyphic material is concerned. The portion 78 has matter printed thereon anaglyphically, and the detachable portion 75 includes a pair of anaglyphic windows 80 and 82 which allow matter printed on the portion 78 to be viewed so as to exhibit a three dimensional effect. In addition, the mailing card 74 has another detachable marginal portion 81 in which a pair of cross-polarized lenses 77 and 79 are set. The cross-polarized lenses 77 and 79 are of the type developed by Polaroid Corporation which are used to view a Vectograph to provide a very realistic three dimensional effect. In a Vectograph one complete image appears in full contrast to the right eye when viewed through the cross-polarized lens 77. This image is invisible to the left eye which looks through the lens 79. Conversely, a complete overlaid image is invisible to the right eye which looks through lens 77 and appears in full contrast to the left eye looking through lens 79. This system is described, for example, at page 30 of the book "Amazing 3-D", by Hal Morgan and Dan Symmes, published by Little, Brown and Co., 1982, Library of Congress Catalog Card Number: 82-82781.

In the mailing card 84 there are a pair of detachable portions 86 and 88. Matter is printed on the remaining portion 90 in two different colors as in the mailing card 84. However, in the mailing card 84 the solutions are presented in different colors. That is, some of the solutions are printed in red ink while other solutions are printed in blue ink. The detachable portion 86 is equipped with a red window 92, while the detachable portion 88 is equipped with a blue window 94. Thus, different solutions to problems printed on the remaining portion 90 are observable by viewing matter printed on the remaining portion 90 through either the window 92 or the window 94. The mailing card 96 has a configuration and construction similar to the mailing card 40, described in association with FIGS. 3–5, but with a blue window 95 and with problem solutions printed in blue ink rather than red ink on the portion 97.

The mailing card 98, on the other hand, includes a set of anaglyphic windows in a detachable portion 100. The portion 100 is detachable from another portion 102 by means of a line of perforation 104. In addition, the mailing card 98 is further comprised of a second detachable portion 106 which contains a pair of transparent Pulfrich windows 108 and 110. The Pulfrich window portion 106 is attached to the remaining portion 102 of the card stock along a perforated demarcation 112. The Pulfrich lenses 108 and 110 may be detached from the remaining portion 102 of the card stock 98 and utilized for observing some motion picture or video tape created so as to exhibit three dimensional images employing the Pulfrich effect.

In a system filmed to take advantage of the Pulfrich effect a motion picture camera records a series of images in which there is consistent relative motion from left to right or right to left between the camera and the subject matter viewed by the camera. An observer wears a pair of glasses in which the two lenses have different coefficients of light transmission. When a motion picture or video tape filmed so as to exhibit a three dimensional system employing the Pulfrich effect is viewed, the eye viewing the image through the transparent window having the greater coefficient of light transmission will transmit its image to the brain slightly ahead of the eye viewing the same subject matter through the window having a lower coefficient of light transmission. The image from the window having the smaller coefficient of light transmission is delayed approximately one thirtieth of a second relative to the image from the window having the greater coefficient of light transmission. The eyes of the viewer thereof transmit images to the brain which are slightly different, at any single instant in time. As a result, the combined image processed by the brain is a composite of the two slightly differing images, and is perceived as a sculptured effect.

If a camera constantly pans a scene or spectacle at a uniform speed, or if the objects on the screen move consistently in a lateral direction, relative to the camera, as in a parade, a sculptured effect will be perceived. The Pulfrich effect is described, for example, at page 24 of the March 14, 1981 edition of TV Guide, and at pages 14 and 15 of the publication Stereo World, Jan.-Feb., 1989.

The detachable portion 106 of the mailing card 98 is a third portion, in addition to the detachable portion 100 and the remaining portion 102. The portion 106 is provided with a pair of openings that are spaced from each other a distance corresponding to the distance of separation between the eyes of a human being. The transparent windows 108 and 110 have different coefficients of light transmission.

FIG. 6 illustrates various other mailing card configurations as well. For example, the mailing card 114 has a detachable section 116 with a lens 118 of a single color for solving solutions to problems presented in the remaining portion 120, and another detachable section 122 having anaglyphic lenses 124 and 126 for viewing matter printed anaglyphically on the portion 120 of the mailing card 114.

The mailing card 130 is similar to the mailing card 84 and differs therefrom only in that the two detachable sections 132 and 134 are detachable along perforated lines 136 and 138 which extend lengthwise, rather than transversely across the card stock. The mailing card 140 is similar to and differs from the mailing card 114 in the same manner.

The mailing card 142 is a variation of the mailing card 98 in which anaglyphic windows 144 and 146 are carried in a detachable portion 148 that separates along a perforated delineation 150 that extends lengthwise along the card stock, rather than transversely. On the opposite side of the card stock a Pulfrich lens section 152 is detachable from the remaining portion of the card stock along an elongated, linear lengthwise perforated line 154, rather than along a transverse perforated delineation.

The mailing card 156 differs from the mailing card 96 only in the lengthwise orientation of the detachable section 158 relative to the remaining section 160. The mailing card 162 similarly differs from the mailing card 74 only by the lengthwise demarcation 164 by which the anaglyphic section 166 is detachably connected to the remaining portion 168.

All embodiments of the mailing card of the invention are extremely simple in construction and versatile in application. Each embodiment requires only a single layer of card stock and does not require any folding or bending of parts for utilization. The mailing card of the invention can be mailed at postcard rates, and requires only detachment of the section bearing the viewing window or windows for utilization. The mailing card of the invention can be employed for any number of different promotional or entertainment purposes. Accordingly, the scope of the invention should not be construed as limited to the specific embodiments depicted and described herein, but rather is defined in the claims appended hereto.

I claim:

1. A mailing card formed of a single sheet of card stock, a perforated delineation extending across said sheet of card stock to define first and second portions thereof and to facilitate complete separation of said first and second portions from each other, at least one opening defined in said first portion of said card stock, at least one transparent window tinted in a first color and disposed in said opening, and matter printed on said second portion of said card stock in both said first color and in at least one other contrasting color, whereby separation of said first and second portions of said card stock and viewing of said printed matter on said second portion through said window in said first portion masks the matter printed in said first color on said second portion from observation through said window.

2. A mailing card according to claim 1 wherein said mailing card is flat and has a face surface and an opposite obverse surface and is rectangular in shape and at least some of said matter is printed on said face surface and an indicia of placement of a postage stamp is printed on said opposite obverse surface.

3. A mailing card according to claim 1 further comprising a pair of openings as aforesaid spaced apart on said first portion of said card stock a distance corresponding to the distance of separation between the eyes of a human being and further comprising a pair of transparent windows disposed in the respective openings, one window tinted in said first color as aforesaid and the other tinted in a second color contrasting with said first color, and further characterized in that said printed matter includes matter printed in an anaglyphic manner including matter printed in both said first and second colors, whereby said printed matter produces a three dimensional image when said first portion of said card stock is separated entirely from said second portion of said card stock and said second portion is viewed through said windows in said first portion by a human being using both eyes.

4. A mailing card according to claim 3 further characterized in that said first color is red and said second color is blue.

5. A mailing card according to claim 1 further comprising an additional perforated delineation extending entirely across said sheet of card stock to define a third portion thereof, a pair of openings defined in said third portion of said card stock and spaced from each other a distance corresponding to the distance of separation between the eyes of a human being and further comprising transparent windows having a different coefficients of light transmission in each of said openings of said third portion.

6. A mailing card according to claim 1 further comprising a detachable attachment flap defined by a separable delineation, whereby said attachment flap is adapted for securement to a publication and said first and second portions of said card stock are removable from said attachment flap together as a unit by separation from said attachment flap at said separable delineation.

7. A mailing card according to claim 1 further characterized in that said printed matter presents a viewer with a mentally solvable problem which is observable with the unaided eye and said printed matter further includes printing in said first color and a solution in said other contrasting color which is obscured when viewed with the unaided eye by printing in said first color, and wherein said solution is visible when said first and second portions of said card stock are separated from each other and said printed matter is viewed through said tinted window.

8. A mailing card comprising single rectangular sheet of only a single thickness of card stock having a face and an opposite obverse surface, an anaglyphic picture printed on said face of said card stock, a pair of spaced openings defined in a marginal portion of said card stock and spaced apart from each other at a distance corresponding to the distance between the eyes of a human being, a set of transparent anaglyphic windows secured across said openings, and a perforated demarcation on said card stock delineating said marginal portion from the remainder of said card stock to facilitate complete separation of said marginal portion from said remainder.

9. A mailing card according to claim 8 further characterized in that one of said anaglyphic windows is tinted red and the other is tinted blue.

10. A mailing card according to claim 8 further comprising an auxiliary portion of said card stock delineated from the remainder thereof by a line of weakness, wherein a pair of openings spaced apart a distance corresponding to spacing of the eyes of a human being are defined in said auxiliary portion, and further comprising a set of Pulfrich lenses disposed in said openings in said auxiliary portion.

11. A mailing card according to claim 8 wherein said card stock is rectangular and flat and has an indicia in one corner on said obverse surface for placement of a postage stamp.

12. A mailing card comprising a flat sheet of card stock rectangular in shape and having a marginal portion with at least one opening defined therein, matter printed on said card stock in a plurality of colors in overlapping fashion, whereby matter printed in at least a first one of said colors on a remaining portion of said card stock other than said marginal portion represents a solution to a problem posed in said printed matter and wherein said solution is obscured by the rest of said printed matter on said remaining portion of said card stock when viewed in ambient light, a transparent window tinted in one of said plurality of colors other than said first one of said colors and set in said opening, and a linear perforation delineating a boundary between said marginal portion and said remaining portion of said card stock for facilitating complete separation of said marginal portion from said remaining portion, whereupon said printed matter on said remaining portion is adapted for viewing through said window which masks observation of portions of said matter printed in the same color as said window to thereby reveal said solution.

13. A mailing card according to claim 12 further characterized in that at least a portion of said matter is printed anaglyphically and said card stock further comprises of an anaglyphic lens section containing a pair of transparent anaglyphic windows and said anaglyphic lens section is detachably secured to said remaining portion of said card stock.

14. A mailing card according to claim 13 further comprising a line of perforations between said anaglyphic lens section and said remaining portion of said card stock.

15. A mailing card according to claim 12 further comprised of a Pulfrich lens section containing a pair of transparent Pulfrich windows and said Pulfrich lens section is attached to said remaining portion of said card stock by detachable means.

* * * * *